US007647939B2

(12) United States Patent
Lin

(10) Patent No.: US 7,647,939 B2
(45) Date of Patent: Jan. 19, 2010

(54) WATER INLET DEVICE FOR A FAUCET

(76) Inventor: Ming-Shuan Lin, No. 29-2, Sec. 1, Tafeng Rd., Tantzu Hsiang, Taichung Hsien (TW)

( * ) Notice: Subject to any disclaimer, the term of this patent is extended or adjusted under 35 U.S.C. 154(b) by 503 days.

(21) Appl. No.: 11/789,627

(22) Filed: Apr. 24, 2007

(65) Prior Publication Data

US 2008/0264502 A1 Oct. 30, 2008

(51) Int. Cl.
*E03C 1/04* (2006.01)

(52) U.S. Cl. ..... 137/315.12; 137/359; 137/801; 4/677

(58) Field of Classification Search ..... 137/315.12, 137/359, 801, 603; 4/677
See application file for complete search history.

(56) References Cited

U.S. PATENT DOCUMENTS 6,345,643 B1 * 2/2002 Ko ..... 137/315.12
7,077,153 B2 * 7/2006 Segien, Jr. ..... 137/359

* cited by examiner

*Primary Examiner*—Kevin L Lee
(74) *Attorney, Agent, or Firm*—David N. Lathrop

(57) ABSTRACT

A water inlet device for a faucet includes a valve seat, a connecting pipe, and a plurality of locking screws. The valve seat includes a surrounding wall having a plurality of protrusions, each of the protrusions being provided with a respective screw hole, a base wall cooperating with the surrounding wall to define a valve space, and a branch pipe extending from the surrounding wall. The connecting pipe has a positioning plate portion disposed to abut against the base wall of the valve seat and formed with a plurality of fastener holes, a guide pipe portion, and an inner hole in spatial communication with the valve space in the valve seat. The locking screws extend respectively through the fastener holes in the positioning plate portion of the connecting pipe and engage threadedly and respectively the screw holes in the protrusions of the surrounding wall of the valve seat.

3 Claims, 5 Drawing Sheets

WATER INLET DEVICE FOR A FAUCET

BACKGROUND OF THE INVENTION

1. Field of the Invention

The invention relates to tapware, more particularly to a water inlet device for a faucet.

2. Description of the Related Art

As shown in FIG. 1, a conventional water inlet device 3 is adapted for use in a faucet 2. Aside from the conventional water inlet device 3, the faucet 2 includes a valve 4 for controlling water flow, a handle 5 secured to one end of the valve 4, a water outlet unit 6 connected to the conventional water inlet device 3, and a water inlet pipe 7 coupled to the conventional water inlet device 3. The conventional water inlet device 3 is secured to a deck 300 through a locking collar 8 and is disposed between the water outlet unit 6 and the water inlet pipe 7. The conventional water inlet device 3 is made from plastic, and includes a valve seat 301 and a connecting pipe 302 that is connected integrally to the valve seat 301. However, since the valve seat 301 and the connecting pipe 302 of the conventional water inlet device 3 are formed integrally, the entire conventional water inlet device 3 will have to be replaced even when only the valve seat 301 is broken, thereby resulting in higher maintenance costs.

As shown in FIG. 2, another conventional water inlet device 9 includes a valve seat 901 that is made from plastic, and a connecting pipe 902 that is made from metal, and that is connected separably to the valve seat 901. The valve seat 901 of this conventional water inlet device 9 has a pipe coupling portion 903 that has a guide hole 903' through which water flows. The connecting pipe 902 of this conventional water inlet device 9 has an inner hole 904 that is formed with an internal thread part 905 for threaded engagement with the pipe coupling portion 903 of the valve seat 901, and a hexagonal part 906 for engagement with a tool (not shown). This conventional water inlet device 9 is secured to a deck 908 through a locking collar 907. However, since the pipe coupling portion 903 of the valve seat 901 has a relatively thin structure, when the locking collar 907 is used to fasten the conventional water inlet device 9 to the deck 908, a tensile force that is applied by the locking collar 907 to the connecting pipe 902 may cause the pipe coupling portion 903 to fracture. Moreover, the disposition of the internal thread part 905 and the hexagonal part 906 of the inner hole 904 of this conventional water inlet device 9 will result in a relatively high manufacturing cost.

SUMMARY OF THE INVENTION

Therefore, the object of the present invention is to provide a water inlet device for a faucet that has a simple structure, a high strength, a low manufacturing cost, and whose components can be replaced separably.

Accordingly, a water inlet device for a faucet of the present invention is adapted to be disposed between a water inlet pipe and a water outlet unit of the faucet, and is adapted to be secured to a deck through a locking collar. The water inlet device comprises a valve seat, a connecting pipe, and a plurality of locking screws. The valve seat includes a surrounding wall, a base wall and a branch pipe. The surrounding wall of the valve seat surrounds an axis and has an outer surrounding surface, a bottom edge, and a plurality of protrusions that protrude radially and outwardly from the outer surrounding surface, and that are each provided with a respective screw hole. The base wall of the valve seat is connected to the bottom edge of the surrounding wall, and cooperates with the surrounding wall to define a valve space. The branch pipe of the valve seat extends from the outer surrounding surface of the surrounding wall, is in spatial communication with the valve space in the base wall, and is adapted to be connected to the water outlet unit. The connecting pipe has a positioning plate portion, a guide pipe portion, and an inner hole. The positioning plate portion of the connecting pipe is disposed to abut against the base wall of the valve seat, and is formed with a plurality of fastener holes corresponding in position to the protrusions of the surrounding wall of the valve seat. The guide pipe portion of the connecting pipe is connected integrally to the positioning plate portion and is formed with an external thread for threaded engagement with the locking collar. The inner hole in the connecting pipe extends from the positioning plate portion to the guide pipe portion, is in spatial communication with the valve space in the valve seat, and has a pipe connecting part defined by the guide pipe portion and adapted for connection with the water inlet pipe. The locking screws extend respectively through the fastener holes in the positioning plate portion of the connecting pipe, and engage threadedly and respectively the screw holes in the protrusions of the surrounding wall of the valve seat, thereby fastening the connecting pipe to the valve seat.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 5:
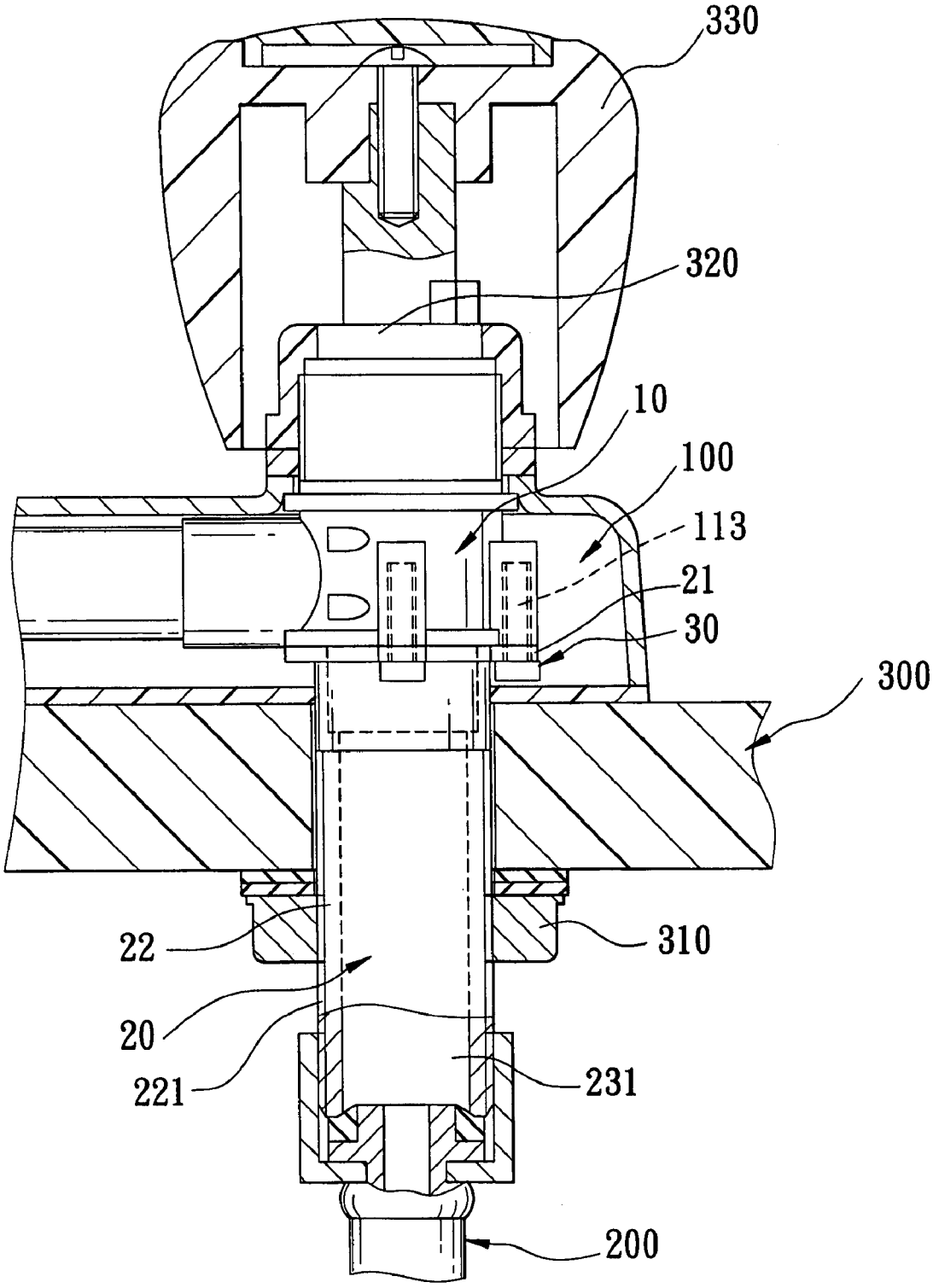
FIG. 5 is an assembled partly sectional schematic view of the preferred embodiment.

As shown in FIG. 5, the preferred embodiment of a water inlet device 100 for a faucet according to the present invention is adapted to be disposed between a water inlet pipe 200 and a water outlet unit (not shown), and is adapted to be secured to a deck 300 through a locking collar 310. The water inlet device 100 comprises a valve seat 10, a connecting pipe 20 and a plurality of locking screws 30.

Figure 1:
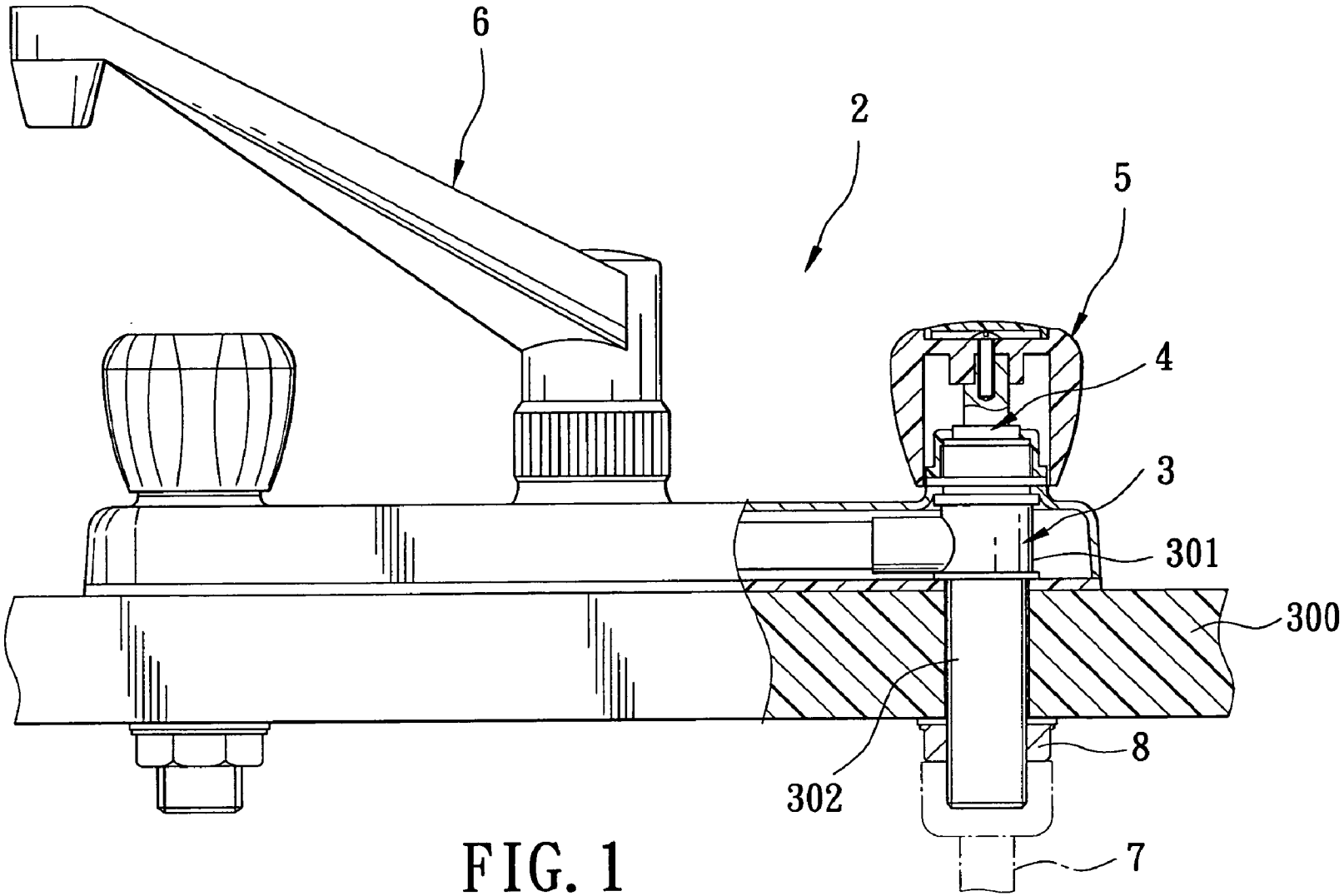
FIG. 1 PRIOR ART
FIG. 1 is an assembled schematic view of a conventional water inlet device for a faucet.
Figure 2:
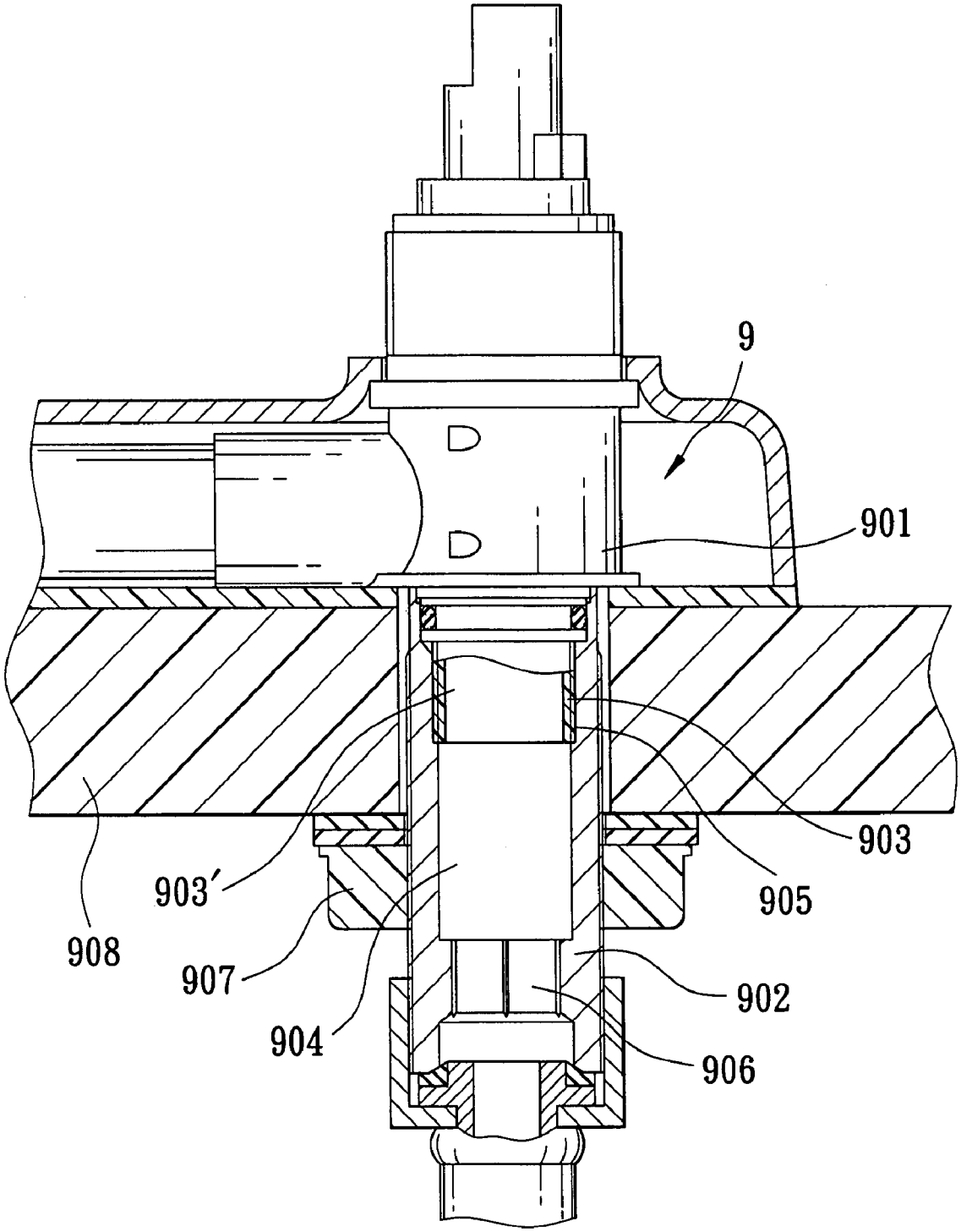
FIG. 2 PRIOR ART
FIG. 2 is a partly sectional schematic view of another conventional water inlet device for a faucet.
Figure 3:
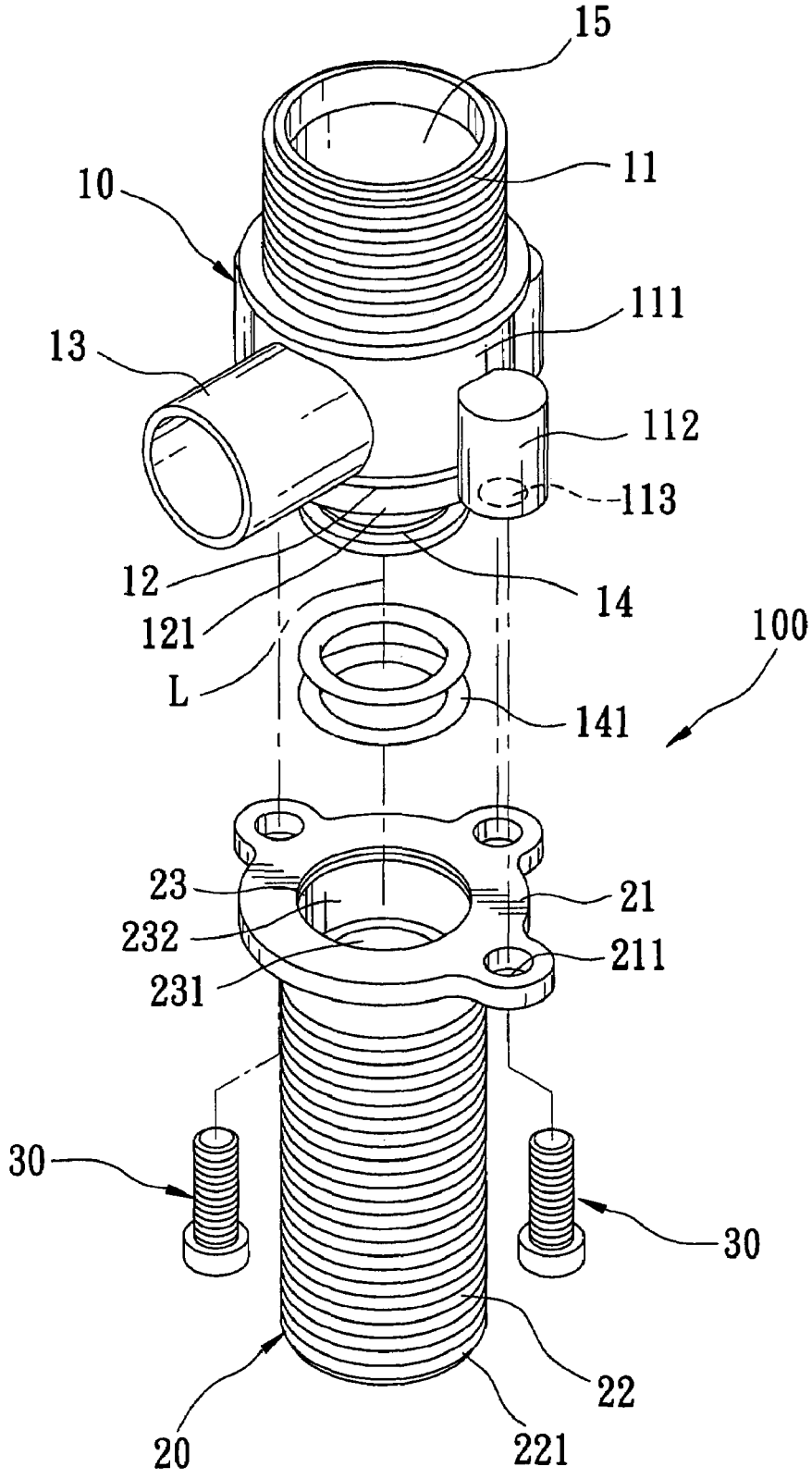
FIG. 3 is an exploded perspective view of a preferred embodiment of a water inlet device for a faucet according to the invention.
Figure 4:
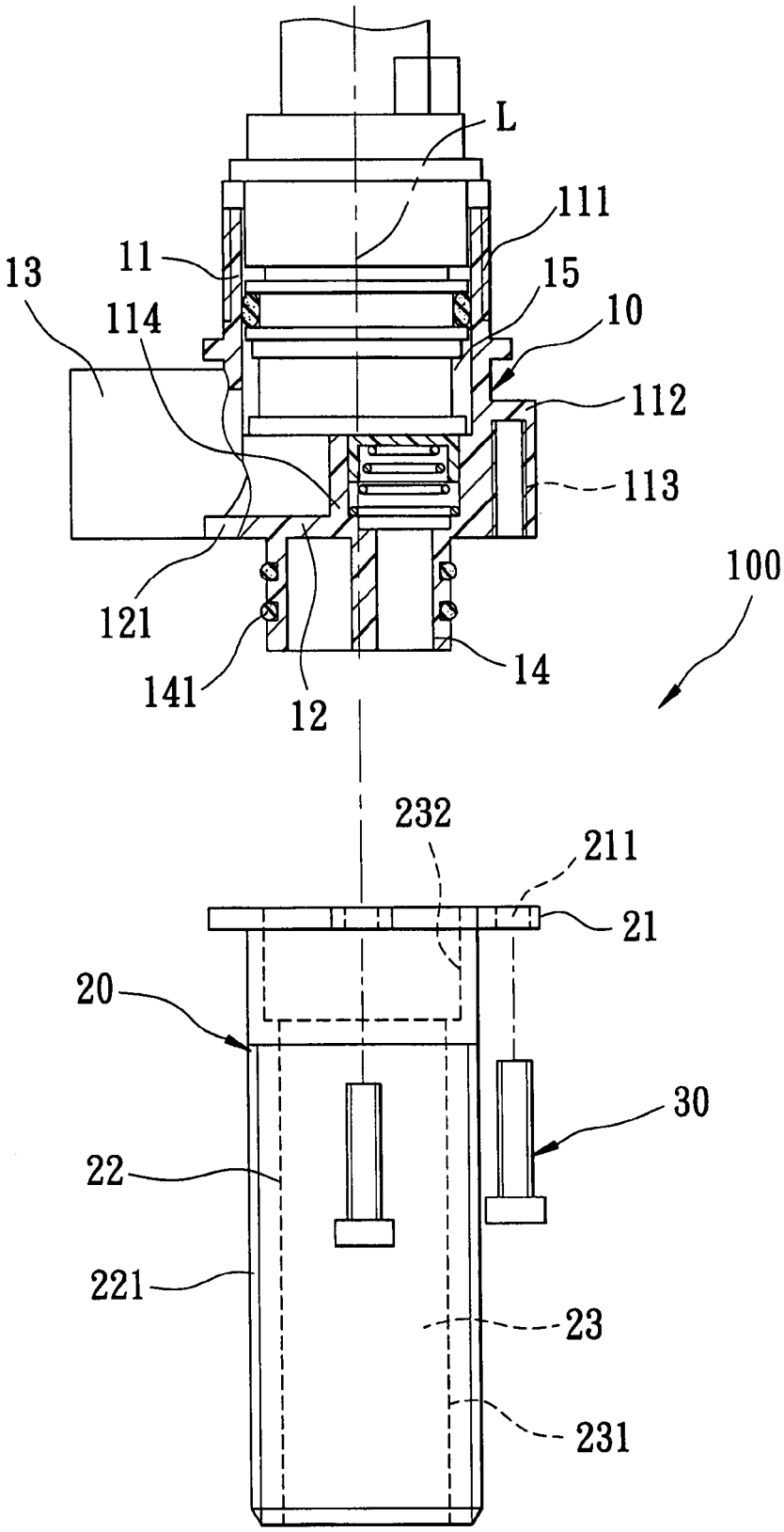
FIG. 4 is an exploded partly sectional schematic view of the preferred embodiment.

As shown in FIGS. 3 and 4, the valve seat 10 is made from plastic, and includes a surrounding wall 11, a base wall 12, a branch pipe 13, and a coupling sleeve 14. The surrounding wall 11 surrounds an axis (L), and has an outer surrounding surface 111, a bottom edge 114, and a plurality of protrusions 112 that protrude radially and outwardly from the outer surrounding surface 111, and that are each provided with a respective screw hole 113. The base wall 12 is connected to the bottom edge 114 of the surrounding wall 11, and cooperates with the surrounding wall 11 to define a valve space 15. The branch pipe 13 extends from the outer surrounding surface 111 of the surrounding wall 11, is in spatial communication with the valve space 15, and is adapted to be connected to the water outlet unit in a conventional manner. The coupling sleeve 14 is fitted with a pair of O-rings 141 therearound.

The connecting pipe 20 can be made from plastic, stainless steel, or copper, and has a positioning plate portion 21, a guide pipe portion 22, and an inner hole 23. The positioning plate portion 21 is disposed to abut against the base wall 12 of the valve seat 10, and is formed with a plurality of fastener holes 211 corresponding in position to the protrusions 112 of the surrounding wall 11 of the valve seat 10. The guide pipe portion 22 is connected integrally to the positioning plate portion 21, and is formed with an external thread 221 for threaded engagement with the locking collar 310. The inner hole 23 extends from the positioning plate portion 21 to the guide pipe portion 22 along the axis (L), and is in spatial communication with the valve space 15 in the valve seat 10. The inner hole 23 has a pipe connecting part 231 defined by the guide pipe portion 22 and adapted for connection with the water inlet pipe 200, and a coupling part 232 disposed above the pipe connecting part 231 and having a diameter larger than that of the pipe connecting part 231.

The coupling sleeve 14 of the valve seat 10 extends downwardly from the base wall 12 of the valve seat 10 into the coupling part 232 of the inner hole 23 in the connecting pipe 20. By virtue of the O-rings 141 on the coupling sleeve 14 of the valve seat 10, a watertight coupling is achieved between the coupling sleeve 14 and the connecting pipe 20 to prevent water leakage. The base wall 12 of the valve seat 10 is formed with a flange 121 that protrudes radially and outwardly relative to the outer surrounding surface 111 of the surrounding wall 11 and that is disposed to abut against the positioning plate portion 21 of the connecting pipe 20. The disposition of the flange 121 of the base wall 12 of the valve seat 10 enlarges the contact area between the valve seat 10 and the connecting pipe 20, thereby increasing the structural strength of the water inlet device 100 after the valve seat 10 is coupled to the connecting pipe 20.

The locking screws 30 extend respectively through the fastener holes 211 in the positioning plate portion 21 of the connecting pipe 20, and engage threadedly and respectively the screw holes 113 in the protrusions 112 of the surrounding wall 11 of the valve seat 10, thereby fastening the connecting pipe 20 to the valve seat 10.

As shown in FIGS. 4 and 5, after the connecting pipe 20 is fastened to the valve seat 10 through the locking screws 30, the water inlet device 100 of the present invention can be mounted on the deck 300 through the threaded engagement between the external thread 221 of the guide pipe portion 22 of the connecting pipe 20 and the locking collar 310. The water inlet device 100 will then be installed with a valve 320 inside the valve seat 10 and a handle 330 secured to the valve 320, and be connected between the water inlet pipe 200 and the water outlet unit to form the faucet. By turning the handle 330 to rotate the valve 320 relative to the valve seat 10, water flow can be controlled.

Therefore, since the valve seat 10 and the connecting pipe 20 are connected separably, a user only has to replace a broken valve seat 10 with a new one instead of replacing the entire water inlet device 100, thereby reducing the repair cost. In addition, it is easy to fasten the valve seat 10 to the connecting pipe 20 or to separate the valve seat 10 from the connecting pipe 20 by just tightening or loosening the locking screws 30. Moreover, since the protrusions 112 of the surrounding wall 11 of the valve seat 10 protrude integrally from the outer surrounding surface 111 of the surrounding wall 11, the locking screws 30 can engage threadedly and respectively the screw holes 113 in the protrusions 112 to couple the valve seat 10 and the connecting pipe 20 together without damaging either one of them, thereby resulting in a high strength for the water inlet device 100. Furthermore, the inner hole 23 in the connecting pipe 20 is formed with no internal thread or hexagonal part, thereby resulting in a simple structure and a lower manufacturing cost for the water inlet device 100.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A water inlet device for a faucet, said water inlet device being adapted to be disposed between a water inlet pipe and a water outlet unit of the faucet, and being adapted to be secured to a deck through a locking collar, said water inlet device comprising:

a valve seat including a surrounding wall that surrounds an axis and that has an outer surrounding surface, a bottom edge, and a plurality of protrusions that protrude radially and outwardly from said outer surrounding surface, and that are each provided with a respective screw hole, a base wall that is connected to said bottom edge of said surrounding wall and that cooperates with said surrounding wall to define a valve space, and a branch pipe that extends from said outer surrounding surface of said surrounding wall, that is in spatial communication with said valve space, and that is adapted to be connected to the water outlet unit;

a connecting pipe having a positioning plate portion that is disposed to abut against said base wall of said valve seat, and that is formed with a plurality of fastener holes corresponding in position to said protrusions of said surrounding wall of said valve seat, a guide pipe portion that is connected integrally to said positioning plate portion and that is formed with an external thread for threaded engagement with the locking collar, and an inner hole that extends from said positioning plate portion to said guide pipe portion, that is in spatial communication with said valve space in said valve seat, and that has a pipe connecting part defined by said guide pipe portion and adapted for connection with the water inlet pipe; and a plurality of locking screws extending respectively through said fastener holes in said positioning plate portion of said connecting pipe and engaging threadedly and respectively said screw holes in said protrusions of said surrounding wall of said valve seat, thereby fastening said connecting pipe to said valve seat.

2. The water inlet device as claimed in claim 1, wherein:

said inner hole in said connecting pipe further has a coupling part that is disposed above said pipe connecting part, and that has a diameter larger than that of said pipe connecting part, and said valve seat further includes a coupling sleeve that extends downwardly from said base wall into said coupling part of said inner hole in said connecting pipe.

3. The water inlet device as claimed in claim 1, wherein said base wall of said valve seat is formed with a flange that protrudes radially and outwardly relative to said outer surrounding surface of said surrounding wall and that is disposed to abut against said positioning plate portion of said connecting pipe.

* * * * *